US006414663B1

(12) United States Patent
Manross, Jr.

(10) Patent No.: US 6,414,663 B1
(45) Date of Patent: Jul. 2, 2002

(54) SELF-CONTAINED ELECTRONIC MEMORIAL

(76) Inventor: Delbert N. Manross, Jr., 112 W. Orchard Ave. Suite 1, Lebanon, OH (US) 45036

( * ) Notice: Subject to any disclaimer, the term of this patent is extended or adjusted under 35 U.S.C. 154(b) by 0 days.

(21) Appl. No.: 09/243,052

(22) Filed: Feb. 2, 1999

Related U.S. Application Data

(60) Provisional application No. 60/073,468, filed on Feb. 2, 1998.

(51) Int. Cl.[7] ..... G09G 3/36

(52) U.S. Cl. ..... 345/87; 345/2; 52/103; 52/134; 52/136

(58) Field of Search ..... 345/1, 2, 3; 52/103, 52/104, 134, 136, 128; 362/86

(56) References Cited

U.S. PATENT DOCUMENTS

| | | | | |
|---|---|---|---|---|
| 2,312,859 A | | 3/1943 | Zentmyer | |
| 3,599,599 A | | 8/1971 | Jones | |
| 3,928,928 A | | 12/1975 | Kalust | |
| 3,990,198 A | | 11/1976 | Ortutay | |
| 4,139,929 A | | 2/1979 | Angermann | |
| 4,169,970 A | | 10/1979 | Opiela et al. | |
| 4,199,848 A | | 4/1980 | Kohnert | |
| 4,227,325 A | | 10/1980 | Whitford | |
| 4,304,076 A | | 12/1981 | Splendora | |
| 4,697,316 A | | 10/1987 | Semon | |
| 4,739,595 A | | 4/1988 | Yamagata | |
| 5,255,170 A | | 10/1993 | Plamp et al. | |
| 5,307,055 A | * | 4/1994 | Baskin et al. | 345/1 |
| 5,517,791 A | | 5/1996 | Weiss | |
| 5,687,515 A | * | 11/1997 | Rodrigues et al. | 52/103 |
| 5,696,488 A | | 12/1997 | Assisi | |
| 5,761,485 A | * | 6/1998 | Munyan | 345/901 |
| 6,037,954 A | * | 3/2000 | McMahon | 345/901 |
| 6,094,871 A | * | 8/2000 | Arnold et al. | 52/103 |

FOREIGN PATENT DOCUMENTS

DE 4423769 C1 11/1995

OTHER PUBLICATIONS

Viewlogy—Memorials that tell a story, Feb. 1998.
Hardware Review—Byting the Dust, Feb. 1998.
Funeral & Cemetary Today, Electronic memorial tells life story, Oct. 1997.
Today in Deathcare, Interview: Deac Manross, Dec. 1997.
The Midtown Journal, Grave markers turn into 'visual eulogy', Sep. 1997.
PC Magazine, Inside Track, May 1997.

* cited by examiner

*Primary Examiner*—Dennis-Doon Chow
*Assistant Examiner*—Alecia D Nelson
(74) *Attorney, Agent, or Firm*—Fay, Sharpe, Fagan, Minnich & McKee, LLP

(57) ABSTRACT

An electronic memorial comprising a programmable memory for storing data regarding a selected individual; a control unit for receiving and processing the data from the programmable memory; an electronic display configured to receive and visually display the processed data; a power source for providing power to the programmable memory, the control unit, and the display; and, a memorial unit corresponding to the selected person and configured to hold the programmable memory, the control unit, the electronic display, and the power source.

13 Claims, 11 Drawing Sheets

SELF-CONTAINED ELECTRONIC MEMORIAL

This application claims benefit to U.S. provisional application Serial No. 60/073,468, filed Feb. 2, 1998.

BACKGROUND OF THE INVENTION

The present invention relates to monuments in general, and in particular to providing an electronic apparatus used with or integrated into gravestones, cemetery urns, mausoleums, and interior of coffins and other memorials allowing for a visual history of a person with which that particular memorial is associated.

Information displayed on gravestones has remained static and minimal for centuries. Name, birthdate, date of death are the limited legacy most people leave behind for their time on earth. Recently, people have begun personalizing their gravestones with near photographic quality images of their homes, cars, portraits, etc. etched directly into the granite gravestone. Small plaques with swinging covers revealing photographs of the deceased have also begun to appear. In the age of a highly fragmented, diverse, and overly-mobile population, this attention to highly individualized grave markers can be attributed to a desire to enhance one's sense of immortality in the context that they are likely not being buried in the traditional small town family cemetery plot where everyone knew them. Recent increasing rates of cremation further fragments the "sense of place" that traditional American burials were grounded in.

SUMMARY OF THE INVENTION

In one embodiment, the present invention mounts tastefully onto existing granite grave markers with a swinging cover to protect it. The invention's use of batteries or small solar cells provides the power to place text and digital photos/images on an LCD display relating to the deceased's life, accomplishments, philosophy, genealogy, favorite photographs, or whatever they would like that could be rendered digitally.

In another embodiment, the invention is configured to place a smaller unit directly inside the coffin itself so that centuries from now if the remains were ever disturbed, people would know not only who this person was, but what their life was like. Mausoleums and crematory urns themselves likewise may have versions of this device adapted for their unique environments. This, in effect, serves the same function and psychological need as the extensive story-telling hieroglyphics in ancient Egyptian pyramids or large monuments to the famous, but in an obviously much smaller and less expensive form. But, unlike ancient royalty, the common man would now have the opportunity to chronicle his life with text and images through the use of this more affordable invention.

The present invention encompasses an electronic device which can be applied directly to a gravestone, crematory urn, mausoleum wall, or any commemorative object. The information regarding the deceased's life is entered first as text and scanned images into a standard personal computer. This information could include the individual's life history, genealogy, creative works, reflections on life, eulogies, accomplishments, digitally rendered photographs of self, family or important places, etc. This personal history can in a present embodiment comprise up to two hundred-fifty-six pages of information; but, as memory storage improves, this amount can be increased.

The information thus gathered is downloaded from a personal computer into the permanent custom memory of the user's unit. The user's personalized version of our product consists of non-volatile memory chips that are permanently etched with each person's life story. The information thus stored uniquely for each individual is then routed to the product's microprocessor-based control unit which passes the individual's life story/photographs to a liquid crystal display on the outside of the unit.

The liquid crystal display (LCD) together with the control unit and personalized memory components draws power from a combination of redundant power sources, connected directly to the unit such that the individual's life story scrolls continuously anytime it becomes activated.

The unit mounts tastefully onto new or existing gravestone markers, with a hinged bronze cover to protect it from direct environmental exposure.

The electronics are encased in a double layer of stainless steel. Mausoleums, crematory urns and other memorial products themselves would likewise have versions of this device adapted for their unique environments. The resultant product then fills, in effect, the same functions and psychological needs as the extensive story-telling hieroglyphics in ancient Egyptian pyramids or the large monuments to the famous, but in an obviously much smaller and less expensive form. Everyone would now have the opportunity to chronicle their life with text and images by means of a reasonably priced product.

BRIEF DESCRIPTION OF THE DRAWINGS

The invention may take form in various components and arrangements of components, and in various steps and arrangements of steps. The drawings are only for the purpose of illustrating a preferred embodiment and are not to be construed as limiting the invention.

DETAILED DESCRIPTION OF THE PREFERRED EMBODIMENT

Figure 1A:
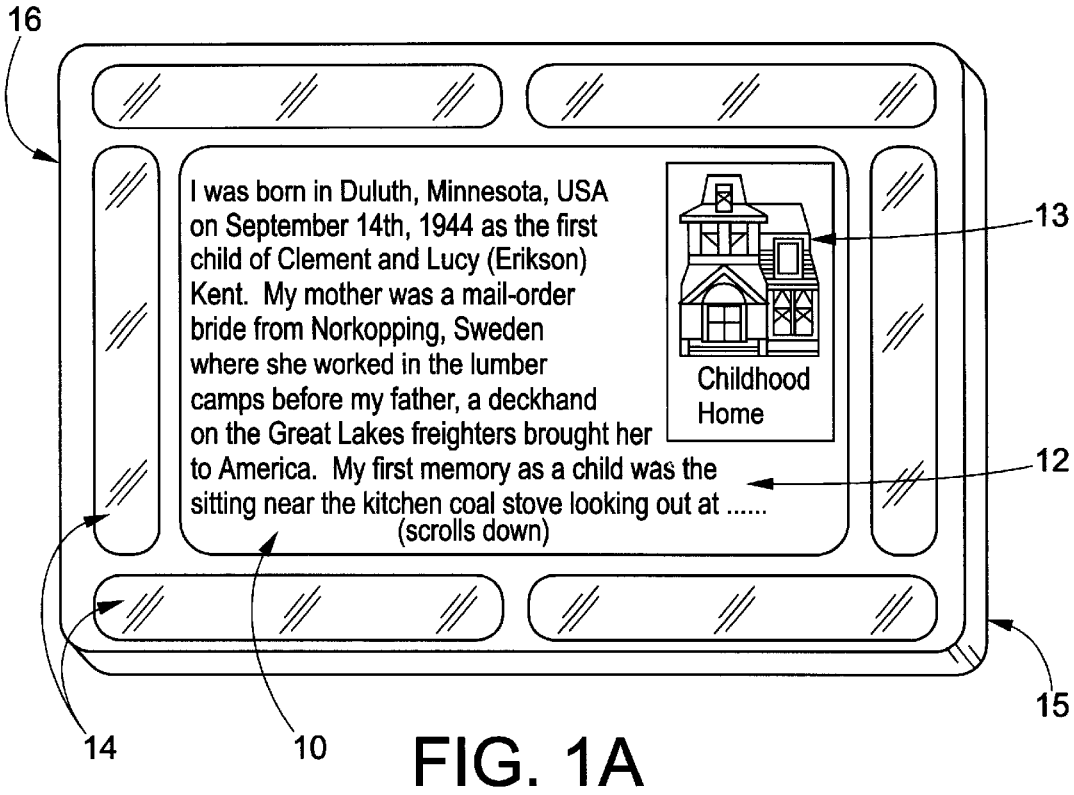
FIG. 1A illustrates a basic view of the present invention viewed by a user.

FIG. 1A shows the basic view that a person would see when viewing an embodiment of this invention. A liquid crystal display 10 present the text 12 and graphic images 13 that would scroll continuously on the liquid crystal display 10. Surrounding the liquid crystal display 10 are solar energy cells 14 which supply the power to the unit. The whole device is enclosed in a protective shock and weather resistant case 15 which protects the unit from vandalism and the elements of nature. When the unit is affixed to a gravestone or a mausoleum wall, it is recessed therein and fixed in place with a flush-mounted frame 16 to secure it. The sunlight strikes the liquid crystal display 10 which then causes the text 12 and graphic images 13 to continuously scroll on the face of the liquid crystal display 10.

Figure 1B:
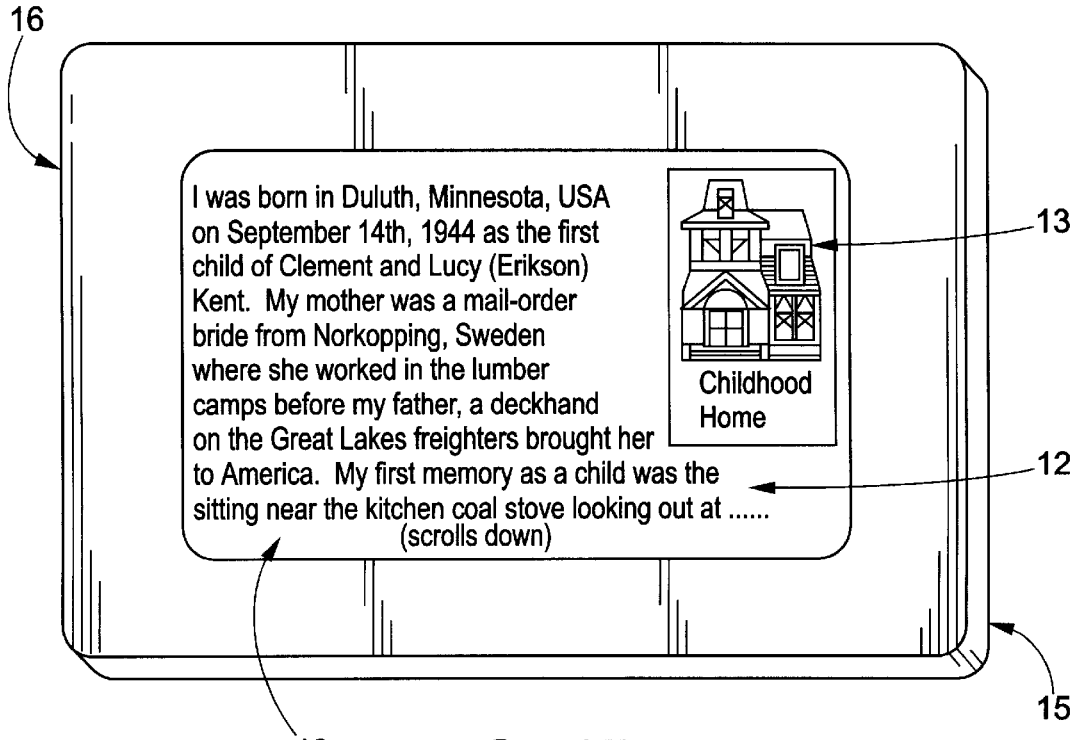
FIG. 1B is a front view of the present invention implementing batteries.

FIG. 1B provides the same view as shown in FIG. 1A, except that in this embodiment, the solar cells 14 are not shown as the invention is powered by batteries.

Figure 2:
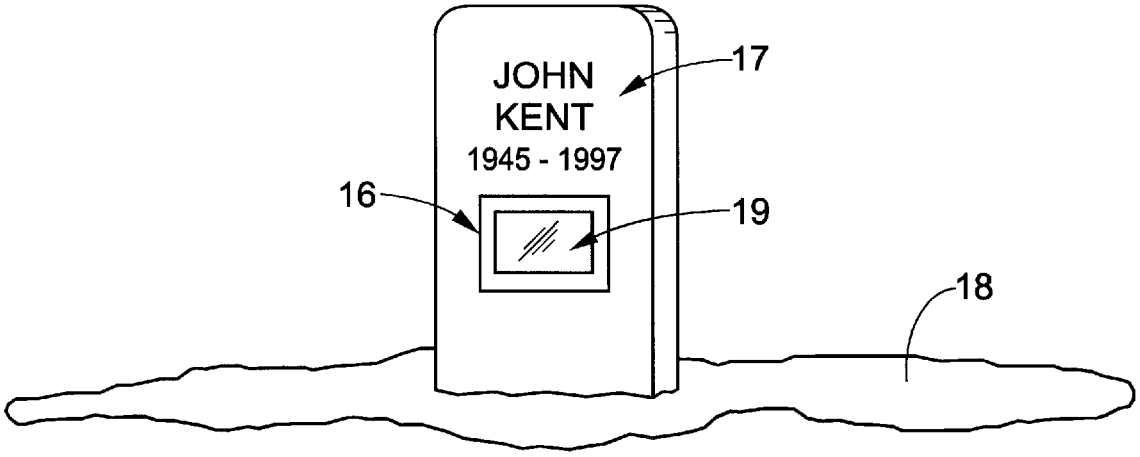
FIG. 2 illustrates the present invention used in a gravestone installation.

FIG. 2 shows a sample installation on a gravestone 17 set into the ground 18. The unit 19 described in FIGS. 1A and 1B is shown mounted to the face of the gravestone 17 and the flush-mounted frame 16 holding it into position. The same unit could be adapted to a mausoleum wall. A smaller version would be adapted to become the base of a crematory urn or to mount inside the coffin itself.

Figure 3:
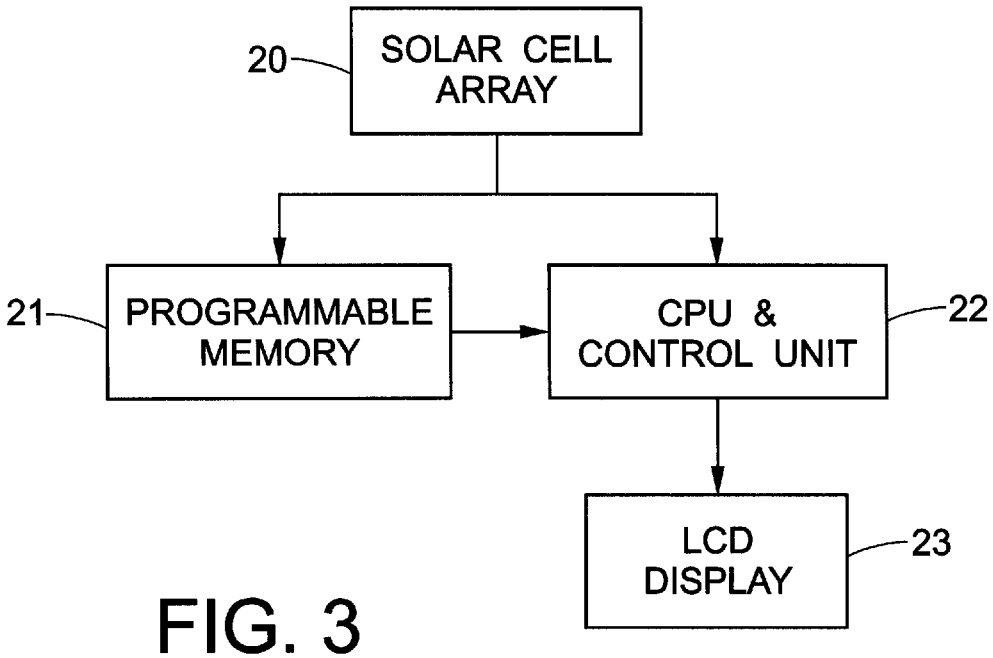
FIG. 3 depicts an electronic block diagram of the digital components of the present invention.

FIG. 3 depicts the electronic block diagram for the digital components of the device. Solar cells 20 supply the power to take the text and graphical information stored in the programmable memory unit 21, have it processed by the CPU and control unit 22 and cause the resultant digital stream to be displayed on the liquid crystal display 23. Due to the longevity required by such an application, redundancy is built into the system wherever possible. It is to be appreciated that in an alternative embodiment, buttons or other control elements could be provided to allow a user to control the scrolling or paging of information.

Figure 4:
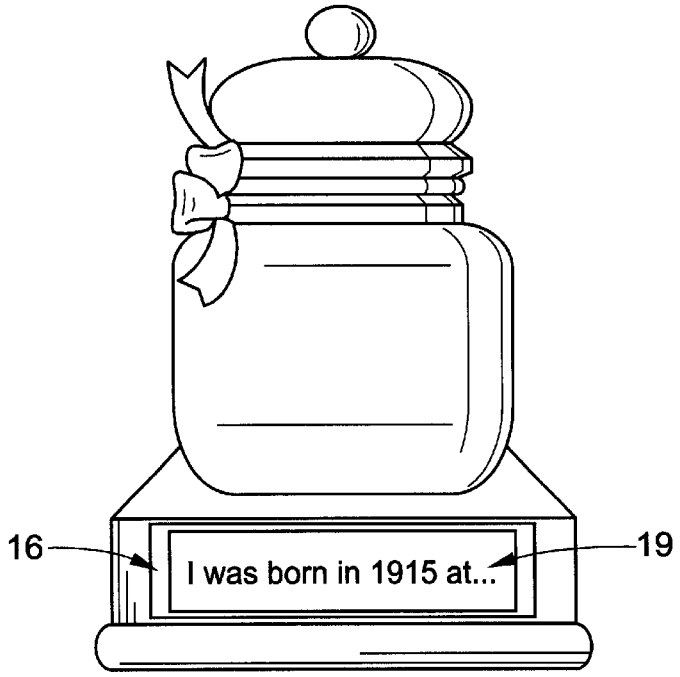
FIG. 4 illustrates the present invention modified for installation with a crematory urn.
Figure 5:
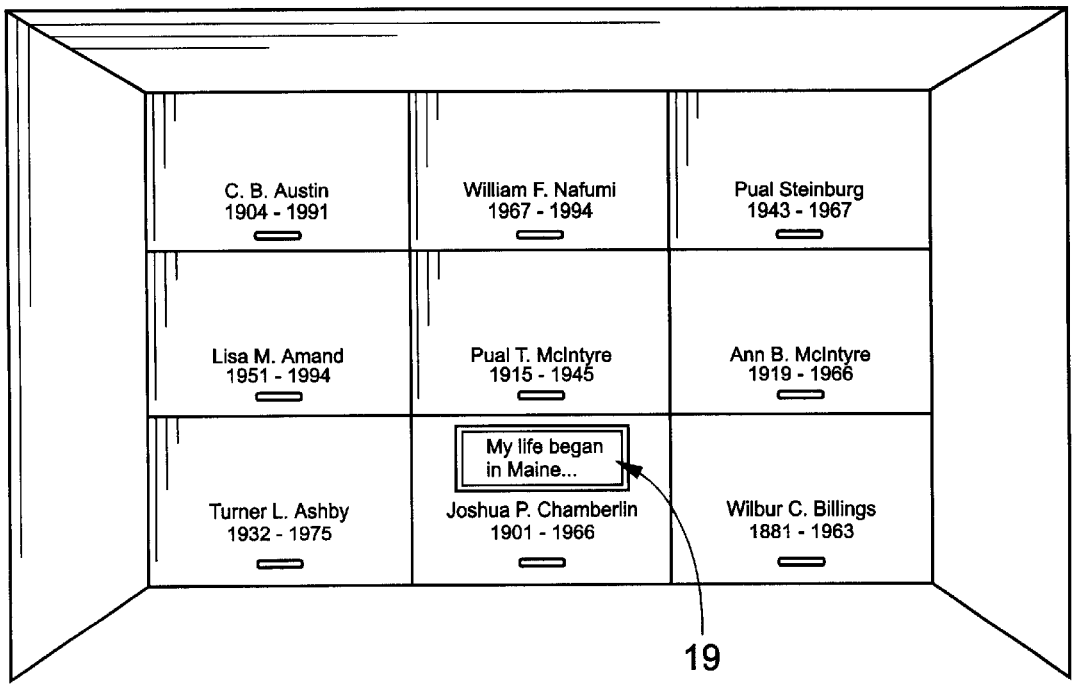
FIG. 5 illustrates the present invention modified for installation in a mausoleum wall.

FIGS. 4 and 5 illustrate the same invention modified for installation in related applications: crematory urns and mausoleum walls respectively. Additionally, this device can be affixed inside the coffin as well (not shown).

As noted, the present invention is adaptable to a number of memorial environments. Since gravestones and cremation urns are the predominant method of remembrance, the following discussion will focus on these areas.

Gravestone: The invention mounts in a recess bored into the stone marker. The unit is embedded in an enclosure that provides a seal to environmental effects. It is then mounted into a double-walled heavy gauge stainless steel housing with a bronze hinged lid. The LCD is protected by, for example, Lexan® (a trademark of General Electric Company) or other appropriate known materials. The whole unit is then affixed directly to the stone marker. The unit is powered by an internal long-life battery or alternatively can be powered by a hand held standard 9 volt battery.

Cremation on Urns: In this case, the invention is integrated into a custom cremation urn of which there are three current models. Since urns are generally located indoors, this iteration of the product is powered by a replaceable battery.

Mausoleum and Niche Wall Mountings: A unit has been developed which can mount on the wall under the name of the deceased. In addition niche wall inserts are also possible.

ROM-only Monuments: For those instances where cost, environmental, vandalism or other operational factors restrict a normal unit installation, a version of the product incorporates only the biographical programmed memory and supporting electronics. This is installed as an unobtrusive bronze disk into a monument and then is interfaced through a specially developed serial cable that downloads the information directly into a standard laptop computer. This unit therefore does not require any LCD display or power and would take up much less room.

Historical Markers and Building Cornerstones: The present invention can be easily adapted to other commemorative markers used throughout the country as self-contained electronic archival information sources.

Product Features:

The present embodiment is designed 256 pages of personalized information in a form factor small enough to be mounted on existing gravestone or other funerary products.

Text, graphics, photographs are able to be digitally rendered and displayed on the screen.

Standard (currently approximately 10 year) replaceable battery powered units are provided when necessary.

Optional power is provided by solar cells designed to provide power for extended time periods The invention is designed to be completely sealed and encased in a permanent sealed stainless steel housing that is impervious to moisture and environmental exposure.

A decorative, hinged bronze cover plate or door is used to protect the unit from direct environmental exposure is provided.

Permanent archiving of the customer's life history is burnt into the computer's memory.

A temperature sensing switch is provided that allows the product only to operate during prescribed allowable temperatures.

Nine volt battery terminal extensions are designed on the face of the invention to be used if solar cells/battery would ever fail.

A mounting frame has an individualized security key (for battery replacement or repair).

Performance and Reliability

The text and pictures of the individual's history are presented a "page" at a time and changed at a preprogrammed interval.

All components selected have tolerances designed to withstand dormancy in environmental extremes and then operate in more temperate conditions Personalized information is permanently etched in programmable read only memory (EPROM's).

The invention is designed to consume very low power to minimize power consumption. Such low power specifications make solar power feasible.

The invention is designed with a custom controller to ensure very few components thus ensuring long term reliability.

Archival service option: if unit would ever fail, all the stored personal history is archived to allow replacing of the original information.

Clear cover over display provides rugged protection.

All metal housings, in one embodiment, are 16 gauge stainless steel for long term, corrosion protection.

The traditional concept of "lifetime" warranty breaks down when dealing with the centuries required for this market. This invention has to last as long as the gravestone itself. However, product failures will occur and have to be accounted for. In addition, since vandalism can be a factor in some cemeteries, there must be a balance struck between a permanent secure product mounting and the ability to retrieve the product for service. A positive aspect of the technology used is that even though the liquid crystal display or solar cells might fail, the personal historical information on each individual is etched permanently into the very silicon of the product and can, in most cases, be retrieved intact.

Tools necessary to remove the unit from the gravestone for service are provided. The product itself will be encased and anchored into the headstone in a stainless steel frame/case in such a way that it is locked flush with the stone, but can be removed by a qualified technician for service. The unit will need no regularly scheduled maintenance.

As memory prices decline, the addition of audio becomes possible as an option. The memory stores digitized speech and the biography could become an oral history as well.

Figure 6:
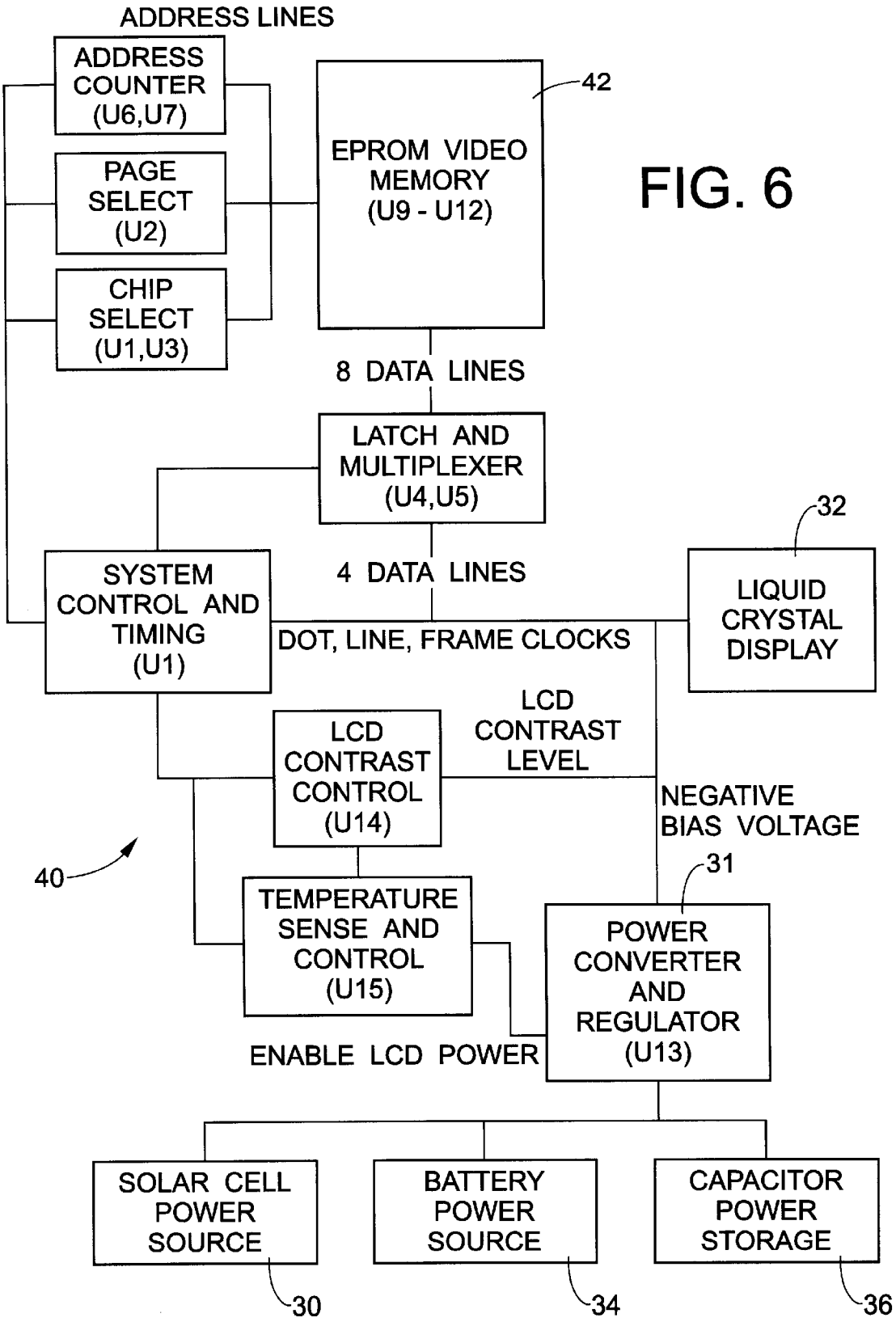
FIG. 6 is a more detailed block diagram of the interconnections of the components according to the present invention.
Figure 7:
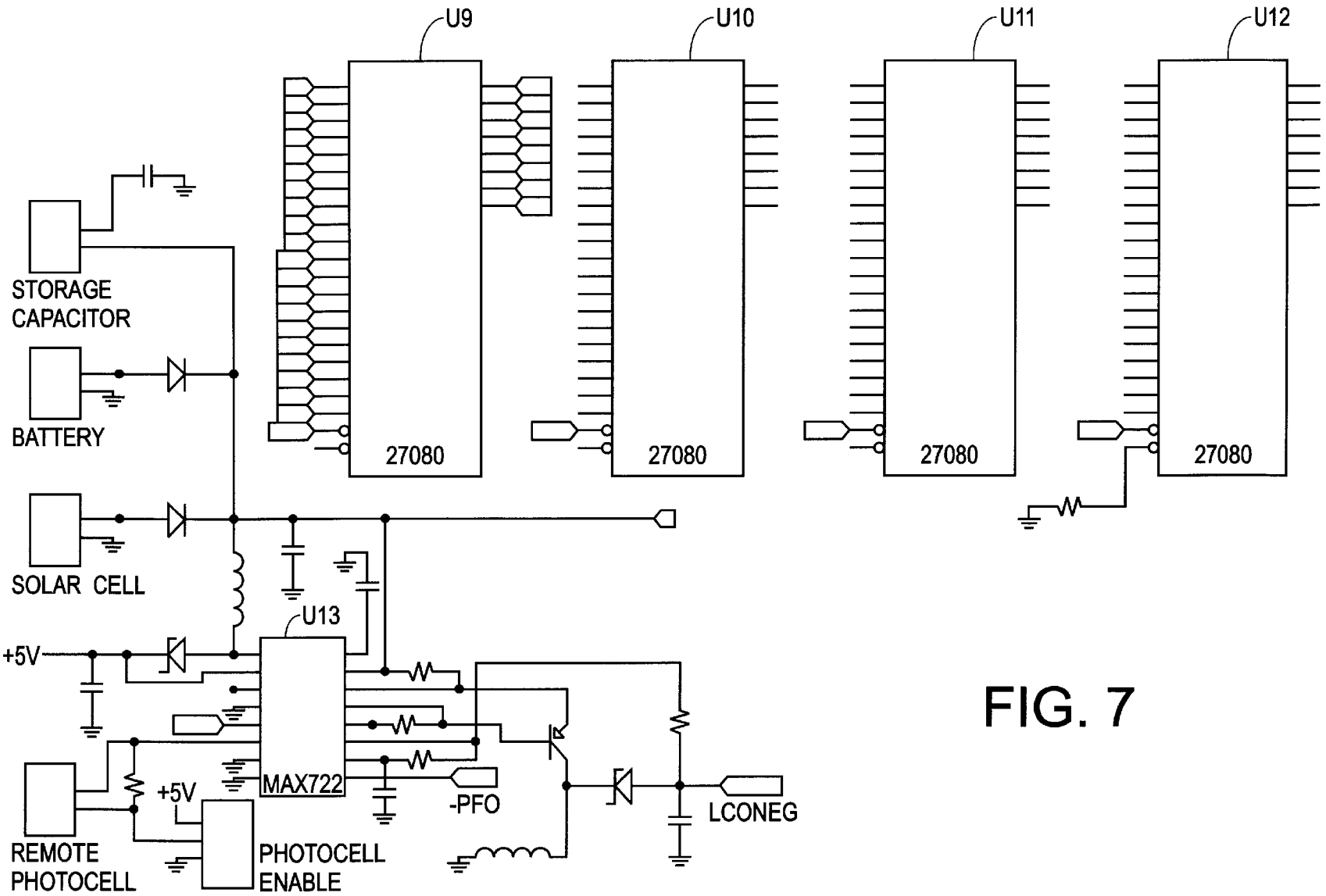
FIGS. 7 and 8 illustrate pinouts for specific chips implementing the present invention.
Figure 8:
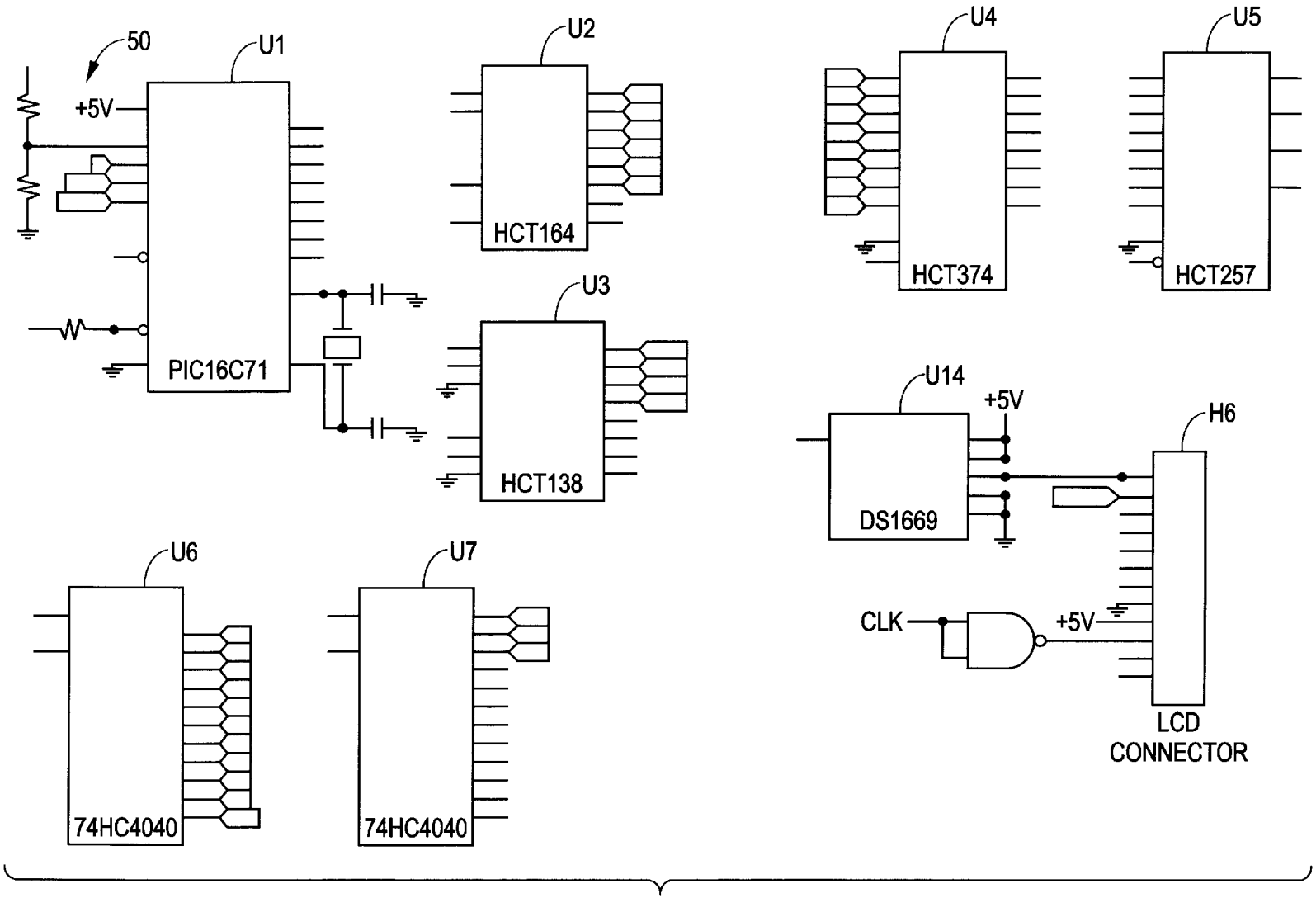

FIGS. 6–8 in combination with the following discussion discuss the electronic powering and display aspects of an embodiment for the present invention.

Product Engineering

A. Solar, Display, and Controller

As shown in FIG. 6, a solar cell power source (which in one embodiment features two solar cells in series, capable of generating a total of 400 milliwatts of power in direct sunlight) 30. The solar cells 30 provide power to a switching power supply (Power Converter and Regulator (U13) 31) that generates the necessary regulated voltages for the logic functions as well as the negative bias voltage required by the LCD screen 32. Other sources of power include a battery power source 34, and capacitor power storage 36. These sources of power are also converted and regulated by power converter and regulator unit 31.

The LCD screen 32 has a resolution of 240×320 pixels, and consumes 185 mWatts, but may be reduced to 150 mWatts in production.

A dedicated single-chip micro controller 40 executes most display controller functions, as well as other supervisory functions. It operates at 16 megahertz, but spends at least half of its time in a low power sleep mode in order to conserve power. In addition to the display controller functions, the micro controller 40 monitors the power output of the solar cells 30, and executes the LCD power-up and power-down sequence, as necessary. The micro-controller 40 also monitors the temperature, and disables LCD display 32 if the temperature exceeds its operating range. The micro controller 40 consumes approximately 35 mwatts.

Control signals required by the display are generated by the micro controller. The controller refreshes the display at 50 hertz. A display memory data path from the ERROM display memory (U9–U12) 42 to the LCD display 32 itself, is controlled by the micro controller 40, but it does not read the data directly.

A standard EPROM design is used as display memory 42, since the data does not change during operation. To conserve power the output is latched as soon as the valid data is available. The display memory consumes about 15 mWatts.

B. Memory Capabilities

The design is capable of supporting four EPROMs which provides storage for 256 pages of display. This could be increased in production units by the incorporation of additional logic.

(1) Mounting to Headstone

The unit consists of two stainless steel components. The outer box is lag bolted into a recess carved in the granite and also supports the bronze hinged decorative cover. The inner box (containing the electronics) installs into the outer box with a custom key cam lock and can be installed in less than a minute. There are multiple mounting configurations depending on whether the product is purchased for a new grave, retrofitted to an old grave, or to be integrated into a cremation urn, etc.

(2) General Specifications

Whenever possible wide temperature range components will be utilized. Micro controller 40 operating temperature range is 55° C. to 125° C., so this is considerably in excess of any system operating conditions, especially considering that the unit will be thermally attached to an infinite heat sink. The storage temperature limitations of the display are −25° C. to 60° C., which again considering that the unit is attached to a heat sink, should be within any anticipated operating conditions. The display operation is limited to 0° C. to 45° C., but the micro controller 40 will assure the unit is not operated outside of these limits.

C. Design Criterion

One consideration in the design of the LCD Controller is to minimize power consumption to permit operation on reasonably sized solar power cell arrays. To this end a customized controller was designed and implemented that, to as large an extent as possible, uses the software of a low-power microprocessor Ul to perform LCD controller functions. It is to be appreciated that in other embodiments, batteries, rather than solar cells, are used to power the unit.

D. Display Memory

Since the display does not change after initial programming, the Electrically Programmed Read Only Memory (EPROM) can be used as display memory 42 to store the images.

E. LCD Display

The LCD display 32 selected was chosen based upon its physical size and low power consumption. In addition to logic level (+5 volt) power it requires a negative bias voltage to operate. The display accepts graphics display data in four bit nibbles and requires timing signals to indicate the availability of a nibble, the end of a display line and the end of the display page. A contrast control level signal o(of LCD contract control unit (U14), is required and is varied depending upon the temperature and characteristics of the individual display.

F. Microprocessor (Device U1)

Microprocessor U1 shown in FIG. 6 may be a Micro Technologies 16C71 microprocessor used in the system to generate all timing signals and to control system operation. Custom firmware for the processor is stored in on-board EPROM memory.

G. Display Function

Microprocessor U1 resets all display logic by asserting the ZERO control which resets the address counters U6, U7. The microprocessor U1 sets the page and chip address in U2. The microprocessor initiates a memory access by generating a (−CS) chip select signal, which is decoded by U3. The eight bit data is latched into U4. The microprocessor generates a CLK signal which transfers a low-order nibble to the display, and generates a signal to transfer the data to the display 32. The multiplexer (U5) shifts the upper nibble, which is transferred to the display. The microprocessor continues this process until an entire line is transferred, then asserts a LLN signal to the LCD display 32 to signal the line is complete. This process is continued until all lines of the display image are transferred to the LCD display 32, then the microprocessor U1 asserts an LFM line to indicate the frame is complete. This process is repeated at least 50 times a second to refresh the display often enough to avoid serious flicker of display.

H. Power Supply

A power converter and regulator (such as a switching mode power supply) implemented by U13 (block 31) generates the +5 volt logic power supply as well as the −18V LCD bias power. The source of the power is either an array of solar cells, an external battery or a non-rechargeable internal battery. For use in situations where the unit is only powered up when viewed, the power supply can be enabled when a sensor generates a voltage indicating the unit's lid has been opened. The generation of the LCD bias voltage is under the control of microprocessor U1. This enables the display's required power up and power down sequences to be followed and to disable the display when the temperature is out of the specified operating limits as determined by temperature sense and control unit (U15). FIGS. 7 and 8 provide a more detailed diagram, showing pinouts of the components of the present invention.

I. Temperature Monitoring

Microprocessor U1 includes an on-board analog-to-digital converter which is used to monitor the voltage across a thermistor 50, of FIG. 8, to give an indication of the ambient temperature. This permits the microprocessor U1 to disable the LCD display 32 when the display's temperature limits are reached as well as to set the display's contrast level, which varies with the ambient temperature by means of LCD Contrast Control Unit U14, a digital variable resistor.

Casing

Figure 10:
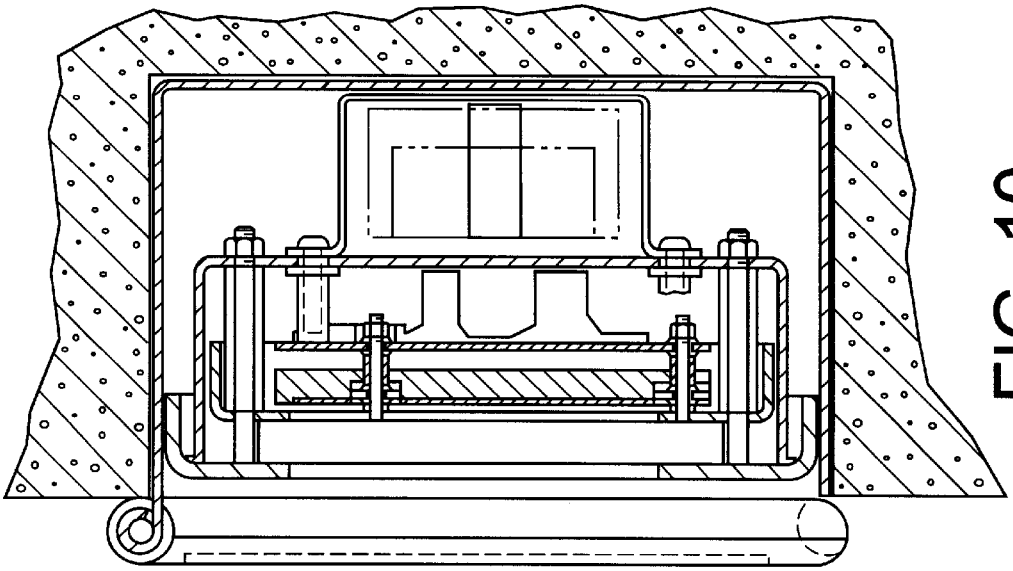
FIG. 10 is a side view of the casting of FIG. 9.
Figure 9:
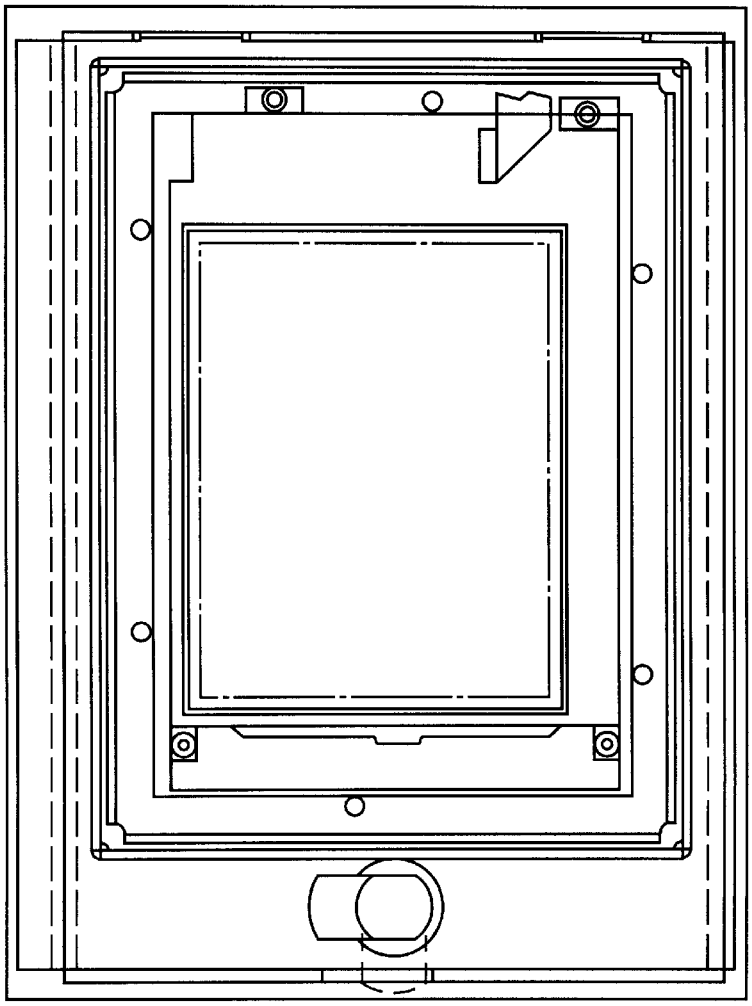
FIG. 9 is a front view of a casing for holding the electronic components of the present invention.

FIGS. 9 and 10 show front and side views of the casing for the present invention. Illustrated therein is the various components used for construction of the casing.

Figure 11:
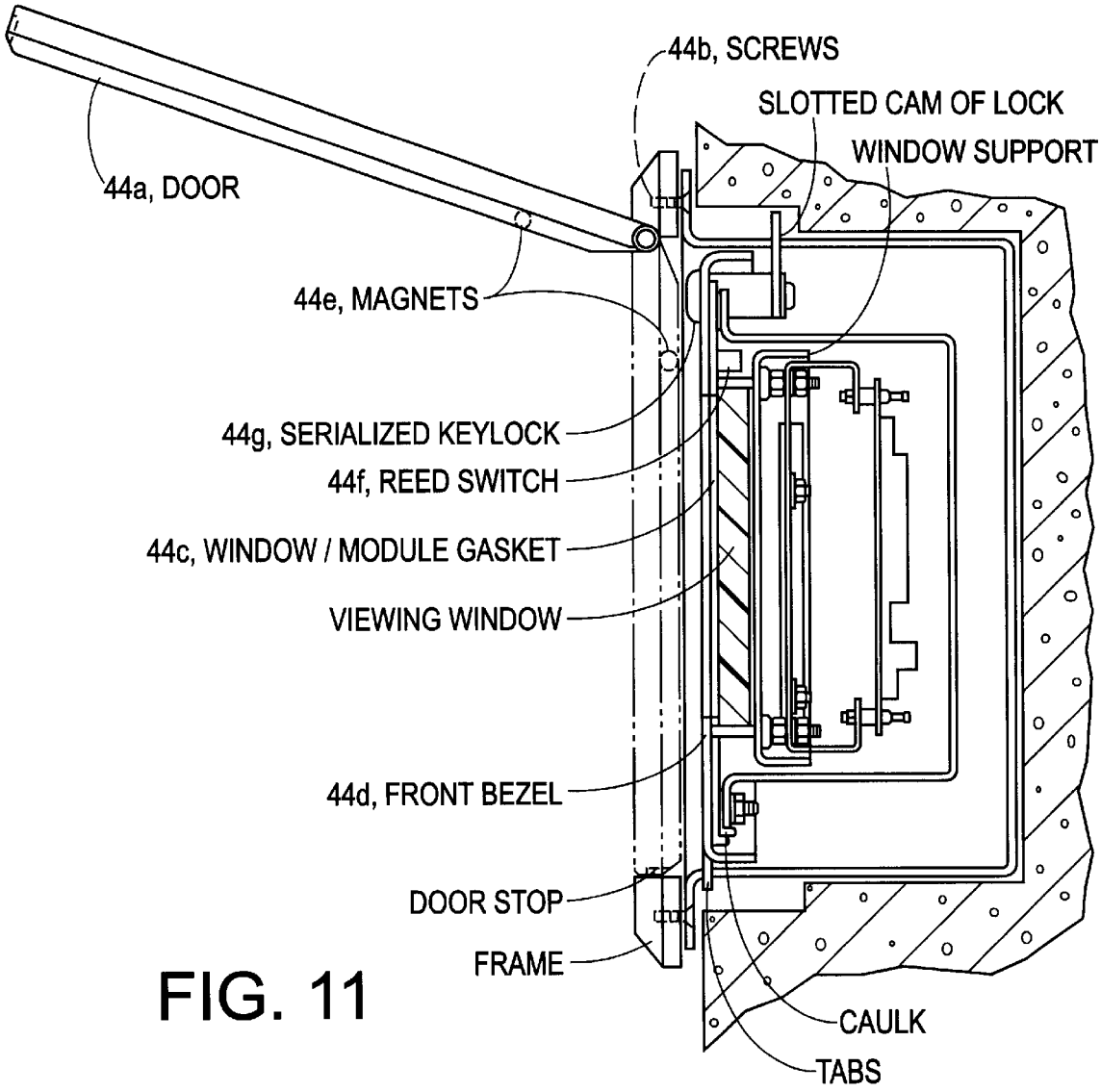
FIG. 11 illustrates a further side view of the casing according to the teachings of the present invention, including an illustration of the door cover.

Side view FIG. 11 illustrates the side view where the door is shown in a closed position.

FIG. 11 illustrates the door in an open position. It may be made of cast bronze or aluminum door. The cast frame door assembly is screwed to rear housing prior to bonding housing into the monument. This provides a finished appearance prior to installation of the internal module after programming the internal module provided and installed into the casing.

Access to a battery compartment is provided via a small hinged door located to the left of the display opening on a front bezel. The battery compartment is completely separate from the electronic cavity to prohibit contamination.

As shown in FIG. 11, a magnet is bonded onto the door and will activate the unit via a reed switch whereby movement of the door open will turn the device on. A serialized key lock is provided at the top of the battery powered unit. While a reed switch is shown in the present invention, an optical sensor may also be used.

Figure 12:
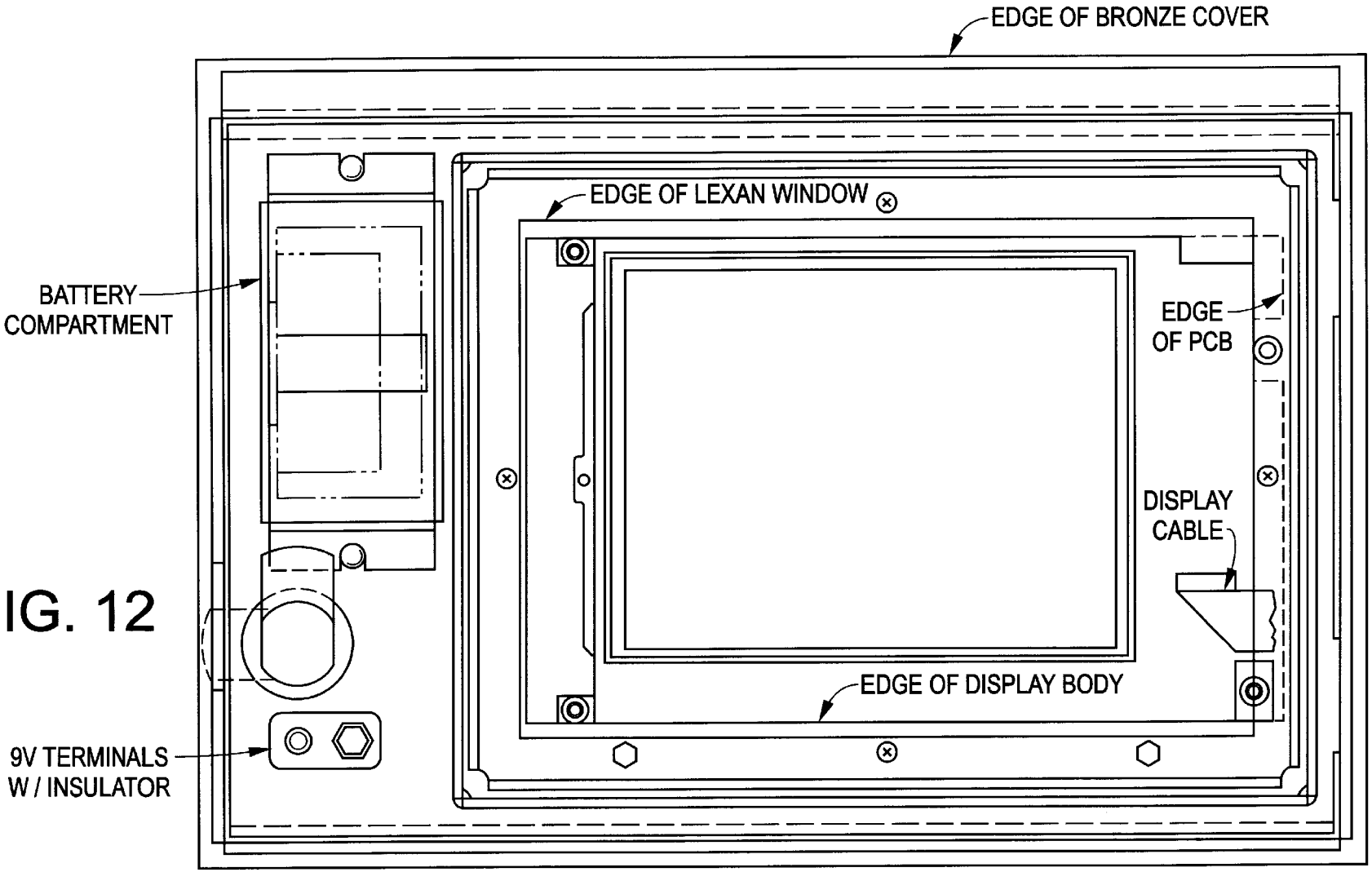
FIG. 12 is a front view illustrating the interconnections for the casing and the electronics of the present invention; and, FIG. 13 is a side view of FIG. 12.
Figure 13:
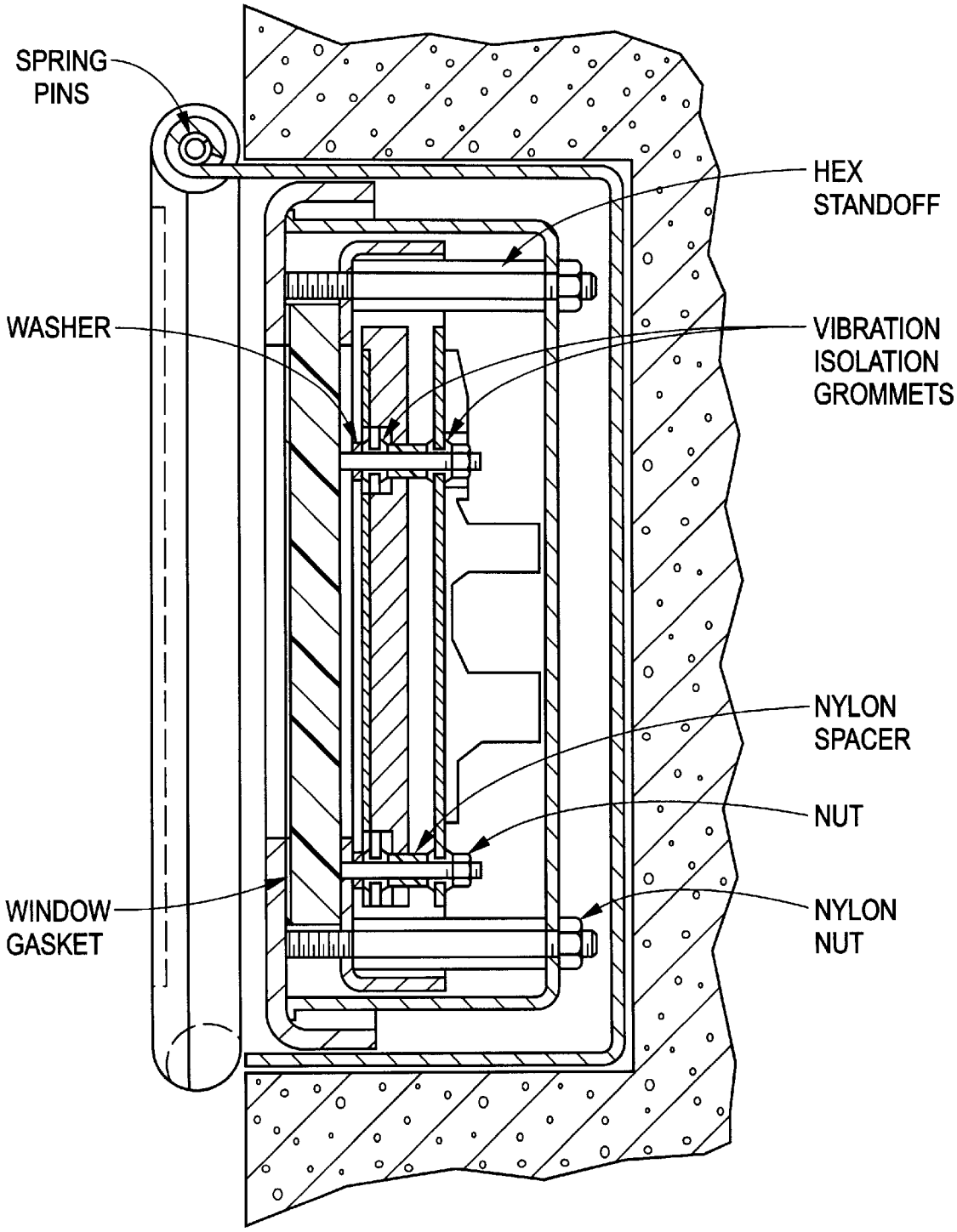

FIGS. 12 and 13 illustrate the casing with additional details. Particularly, the battery compartment is shown in a more detailed view of the device including the LCD display 32 is illustrated.

It is noted the present invention also includes:

(a) Low power mode: If the unit is left on, it will turn itself off after two (2) hours.

(b) Updating: The unit can have information added to three (3) additional times. This allows a unit to be used for a family plot, and where the unit is reconfigured each time another family member dies.

(c)Skip-Page Function: Any page can be "erased" from the unit at any time in the future (in case an error is made or someone changes their mind). The page is not actually erased, but just skipped and, therefore, does not display.

(d) Variable-Time Display: Pages can be programmed to be displayed at various time intervals. This allows for people to spend a longer time on a page of text than on a photograph.

(e) The product has the capability to include "forward" and "reverse" switches so that viewers are not forced to read the biography at the present time intervals.

The non-display version of the invention is just a bronze 4" disk with the electronics sealed in a box behind it that is inserted into the gravestone (or whatever). It has two "contacts" on its face where you connect a special custom serial cable from a laptop computer to download the information.

Therefore, the present invention includes:

Integrated electronic display

Custom biographical "burnt-in" memory chips, including "flash memory" and other ROM memory products Self-contained power It is updatable as other family members die at the burial plot Has an integrated bronze cover to shield environmental effects as well as masking the whole unit to look only like a bronze plaque Temperature sensing ability to be able to adjust the contrast of the LCD "on the fly"

To be used in any memorial application: mausoleums, urns, historical monuments, cornerstone No "on/off" switch in outdoor models. A magnetic reed switch senses if the bronze cover has been opened A unique concept of the present invention is having the information and technology to display the information about the individual at the gravesite itself.

Figure 14:
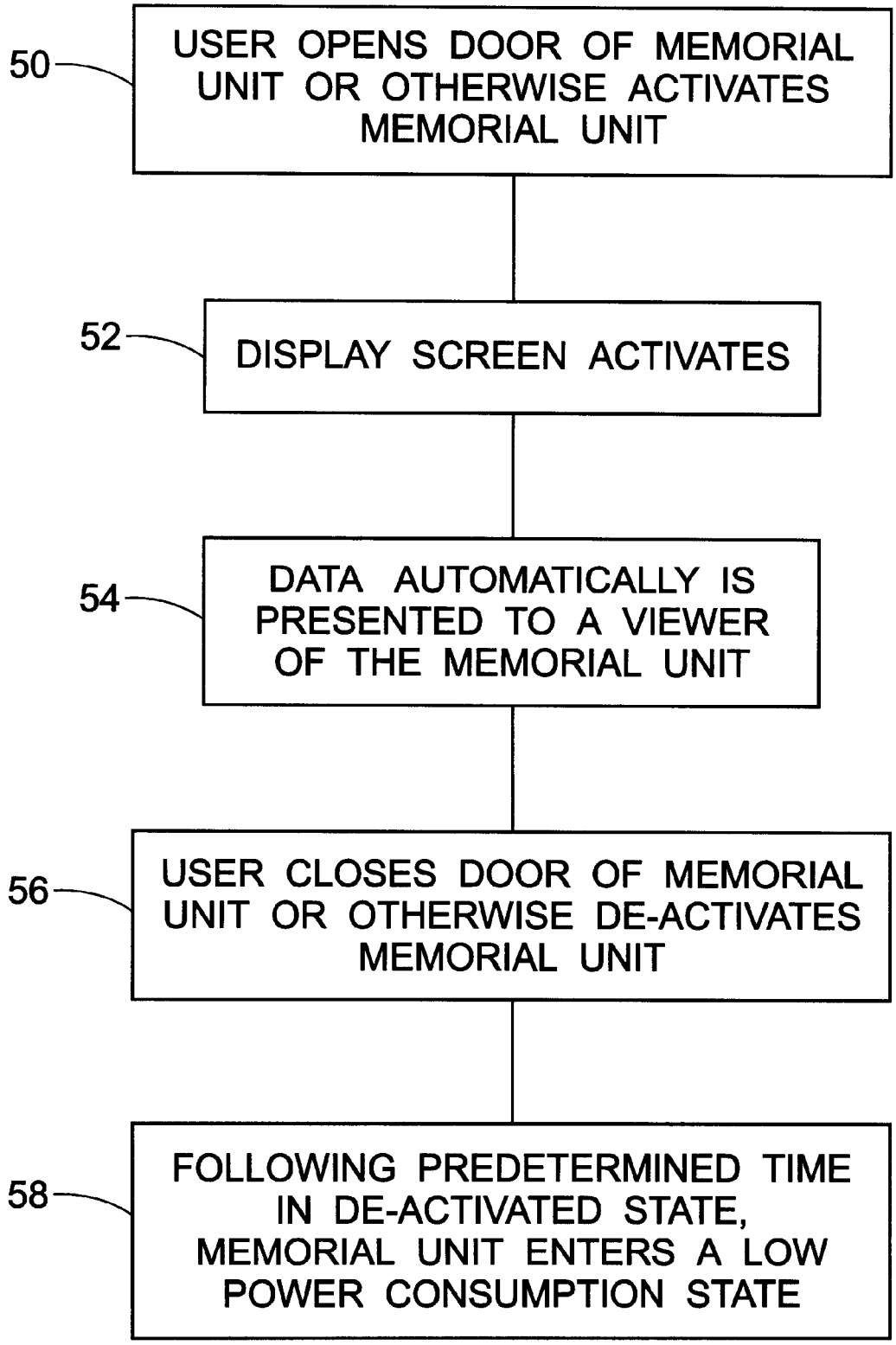
FIG. 14 is a flow chart showing operation of the memorial unit.

FIG. 14 illustrates a simplified block diagram depicting the use of a memorial according to the teachings of the present invention. In particular, in step 50 a user will open the door of the memorial unit or otherwise activate the memorial unit. This may be done by opening the door by the previously discussed switch connection which automatically turns the memorial unit to an on state when a user opens a hinged door. The activation of the memorial unit causes the display screen to be turned on in order to present prestored data regarding the individual associated with the memorial (step 52).

Once the memorial unit is activated, the stored data automatically scrolls the display for viewing by the user. It is noted that push buttons may be provided on the display unit to allow a user to scroll or step t through data (step 54).

Once the user has completed viewing the data, by closing the door of the memorial unit, the unit is deactivated automatically, or some other automatic deactivation of the memorial unit will take place (step 56). This automatic deactivation is desirable as a user may otherwise forget to deactivate the unit thereby draining the units power.

Following a predetermined time of deactivation, the memorial unit is designed to enter a low-power consumption state 58. In other words, the unit is designed to conserve power when not being used. This is particularly important as the power generated by the unit is contained in the unit itself such as by solar cells. Therefore, it is desirable to be as efficient as possible.

What is claimed is:

1. An electronic memorial comprising:

a single environmentally sealed unit designed to be impervious to moisture and environmental exposure, including, a programmable memory for storing data regarding a selected individual, a control unit for receiving and processing the data from the programmable memory, an electronic display configured to receive and visually display the processed data, a power source for providing power to the programmable memory, the control unit, and the display; and a memorial corresponding to the selected person and configured to hold the single environmentally sealed unit, such that the single environmentally sealed unit is mounted into a recess of the memorial such that the electronic display is viewable at the memorial.

2. The electronic memorial according to claim 1 wherein the programmable memory is a electronic programmable ROM (EPROM).

3. The electronic memorial according to claim 1 wherein the electronic display is an LCD.

4. The electronic memorial according to claim 1 wherein the power source is one of batteries and solar cells.

5. The electronic memorial according to claim 1 wherein the memorial unit is at least one of a headstone, cremation urn, and mausoleum plaque.

6. The electronic memorial according to claim 1, further including a casing with a hinged door covering the electronic display when in a closed position.

7. The electronic memorial according to claim 6 further including a switch associated with the hinged door, wherein when the hinged door is opened, the electronic display is activated.

8. The electronic memorial according to claim 1 wherein the programmable memory is capable of storing 256 pages of information.

9. The electronic memorial according to claim 8 wherein the pages of information stored may be changed.

10. The electronic memorial according to claim 1 further including a temperature sensor and controller, wherein when a temperature is sensed outside of a preset value the display is turned off.

11. The electronic memorial according to claim 1 wherein the memorial unit is one of a headstone, gravestone, urn or coffin.

12. The electronic memorial according to claim 1 wherein the control unit is designed to enter a low power consumption mode when the electronic display is in an off state.

13. The electronic memorial according to claim 1 wherein the power source is carried in a same casing as the programmable memory and control unit.

* * * * *